United States Patent [19]

Gastmeier

[11] 4,349,082

[45] Sep. 14, 1982

[54] ACOUSTICAL DAMPING ELEMENT AND METHOD OF FORMING SAME

[75] Inventor: William J. Gastmeier, Waterloo, Canada

[73] Assignee: Unitron Industries Limited, Kitchener, Canada

[21] Appl. No.: 219,394

[22] Filed: Dec. 22, 1980

[51] Int. Cl.[3] ..... H04R 25/00; G10K 11/02

[52] U.S. Cl. ..... 181/130; 181/196

[58] Field of Search ..... 181/129–135, 181/196–197; 73/585, 591, 649; 179/107 R, 107 E

[56] References Cited

U.S. PATENT DOCUMENTS 953,557 3/1910 Shepard ..... 181/196

3,930,560 1/1976 Carlson et al. ..... 181/196 X

*Primary Examiner*—L. T. Hix

*Assistant Examiner*—Thomas H. Tarcza

*Attorney, Agent, or Firm*—Rogers, Bereskin & Parr

[57] ABSTRACT

An acoustical damping element for acoustical tubing such as a hearing aid earpiece, in which a disc of wire screen is positioned over a disc of flexible fabric of a selected acoustic resistance, over the mouth of the tubing. An insertion tool of diameter slightly less than that of the interior passage of the tubing then pushes the composite layers of screen and fabric into the tubing, thereby forming the screen and fabric into closed end concentric cylinders in the passage. The cylindrical sidewall of the screen presses the cylindrical sidewall of the fabric against the interior wall of the tubing to retain the damping element within the passage.

6 Claims, 5 Drawing Figures

ACOUSTICAL DAMPING ELEMENT AND METHOD OF FORMING SAME

This invention relates to a new acoustical damping element for use in acoustical tubing and the like, and to a method for forming the element.

In hearing aids and other acoustical devices, there is commonly a need to place an acoustical damping element in tubing or other cylindrical passage which carries sound. In the past, a pre-formed element has been placed in the sound conducting passage and has then been secured by a mechanical fastener. The need to pre-form the element to suit the diameter of the passage, and then to insert or provide a separate securing device, has resulted in considerable expense and reduces the speed with which the final product, (such as an hearing aid) which includes the damping element can be assembled.

Accordingly, it is the object of the invention to provide an acoustical damping element, and a method for forming the same, which involves extremely low expense both in materials required for the element and in the labour required to form and insert the element.

In one aspect the invention provides in a sound conducting member having an interior passage defined by a cylindrical interior wall, an acoustical damping element comprising: a flexible fabric member of selected acoustic resistance, a wire screen overlying said fabric member, said wire screen and fabric member each having a central circular portion positioned across said interior passage, and each having a periphery bent into a cylindrical sidewall, the cylindrical sidewall of said screen overlying the cylindrical sidewall of said fabric member and pressing the cylindrical sidewall of said fabric member against said interior wall.

In another aspect the invention provides a method of forming an acoustical damping element in a cylindrical passage comprising: positioning a fabric member and a metal screen, each of dimension greater than that of said passage, across the mouth of said passage, with said screen overlying said fabric member, and forcing a cylindrical insertion tool, of diameter slightly less than that of said passage, against said screen to force said screen and fabric into said passage, thereby forming said fabric and screen into closed end concentric cylinders in said passage with said screen pressing said fabric against the wall of said passage.

Further objects and advantages of the invention will appear from the following description, taken together with the accompanying drawings in which.

Figure 1:
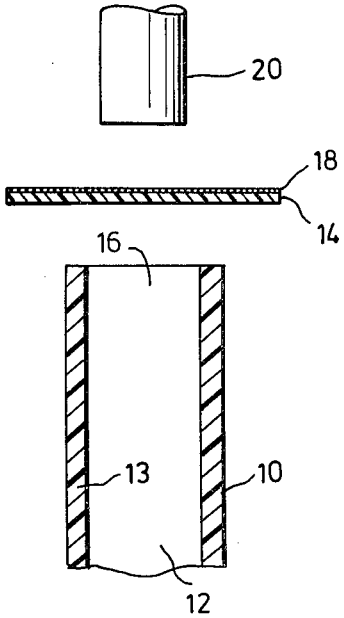
FIG. 1 is a sectional view showing the materials for an acoustical damping element according to the invention in position to be formed into a damping element in a cylindrical tubing.
Figure 2:
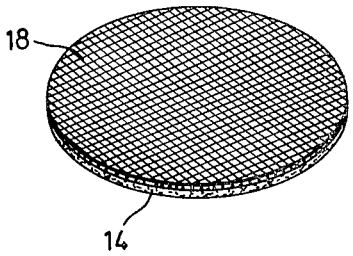
FIG. 2 is a perspective view of the materials of FIG. 1.

With reference to the drawings, it is assumed that an acoustical damping element is to be inserted within a section of hard wall sound conducting tubing 10. The tubing 10 has a cylindrical interior passage 12 defined by an interior wall 13.

To form the damping element, a fabric of selected acoustic resistance is first chosen, and a disc 14 is cut from the fabric. The disc 14 is positioned over the mouth 16 of the tubing 10.

Next, a disc 18 made of a wire screen of low acoustic resistance is placed over the fabric disc 14, over the mouth 16 of the tubing. The screen disc 18 is preferably of the same diameter as the fabric disc 14.

Figure 3:
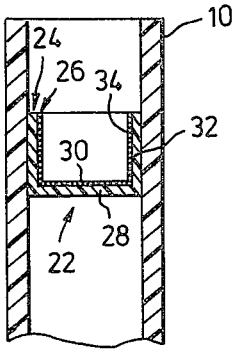
FIG. 3 is a sectional view similar to that of FIG. 1 but showing the materials of FIG. 1 formed into a damping element.

An insertion tool 20 of diameter slightly less than that of the interior passage 12 of the tubing, is then used to force the sandwich consisting of the screen and fabric discs 14, 18 into the tubing. As shown in FIG. 3, this results in a damping element 22, which consists of a pair of closed end concentric cylinders 24, 26. Cylinder 24 is formed from the fabric disc 14 and cylinder 26 is formed from the wire screen disc 18. Each cylinder has a central portion 28, 30, positioned across the passage 12, and a trailing edge or periphery formed into a pair of concentric cylindrical sidewalls 32, 34. It will be seen that the fabric cylindrical sidewall 32 is positioned between the interior wall 14 of the tubing and the screen cylindrical sidewall 34, so that the elasticity of the screen will force the fabric against the wall 13 of the tubing and will retain the fabric in place.

Because the elasticity of the metal screen holds the fabric cylindrical sidewall 32 firmly against the walls of the tubing, little or no leakage of sound occurs around the damping element 22, and at the same time the position of the damping element against shock and air motion is secured. Since the damping element 22 is self-securing, no glue, heat treatment or additional mechanical fasteners are needed.

In addition, the damper is relatively diameter independent, in that tubing or tubular passages with a wide range of diameters can be damped in the manner described. It is necessary only that the length of the cylindrical sidewalls 32, 34 of the damper be sufficient to hold the damper in place. In practice it will normally be sufficient if the length of the cylindrical sidewalls 32, 34 is equal to or greater than about one-third of the diameter of the passage. In practice a length equal to between 0.5 and 1.0 times the diameter of the passage 12, and preferably about 0.75 times the diameter of the passage, is preferred.

A further advantage of the damper of the invention is that it provides low inertance, since dampers formed in the manner described provide almost pure acoustic resistance and hence cause minimal high frequency losses. In addition, a wide range of acoustic resistance is possible, depending on the fabric chosen.

In a typical example of the invention, the tubing 10 was the tubing leading from the transducer of a hearing into the ear canal of a user. The screen disc 18 was formed from stainless steel wire, the wire thickness being about 0.001 inches, with 325 wires per linear inch. Thus the size of the mesh openings (which were square) was about 0.002 inches. Although other elastic metals can be used, such as copper alloys and aluminum, stainless steel was preferred in this environment because of the high humidity and salt (due to sweat) present. The fabric disc 14 was formed from conventional plastic acoustical cloth, with thread thickness about 0.0012 inches formed in a square mesh with 508 threads per linear inch.

Normally the size of the mesh openings of the screen disc will be larger than those of the fabric disc, so that the acoustic resistance of the damping element is controlled by the selection of the fabric. However this is not essential since the acoustic properties of the screen can be taken into account in selecting the fabric for a given acoustic resistance.

Figure 4:
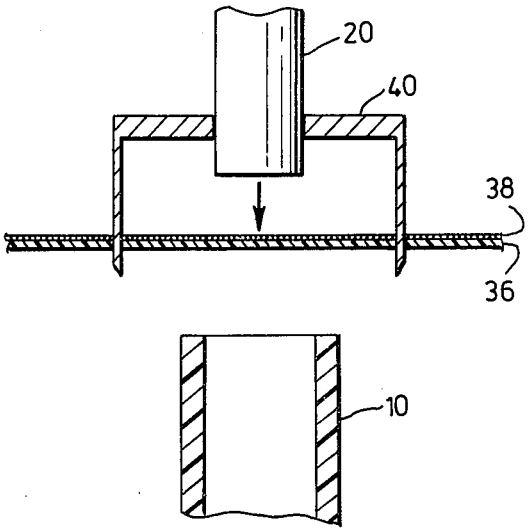
FIG. 4 is a sectional view similar to that of FIG. 1, showing a process for making the damping element.

In a typical production process used for hearing aids, a large sheet of the screen material is positioned over a large sheet of the fabric material, in a jig which also holds a number of hearing aid earpieces (the tubing) below the fabric material. Punches then descend and cut the discs of fabric and screen 14, 18 over each earpiece. A pin then descends through the centre of the punch and acts as an insertion tool to force the discs 14, 18 into the tubing. This arrangement is diagrammatically shown in FIG. 4, where the large sheets of fabric and screen are shown at 36 and 38 respectively, the punch is shown at 40, and the pin or insertion tool is again shown at 20.

Figure 5:
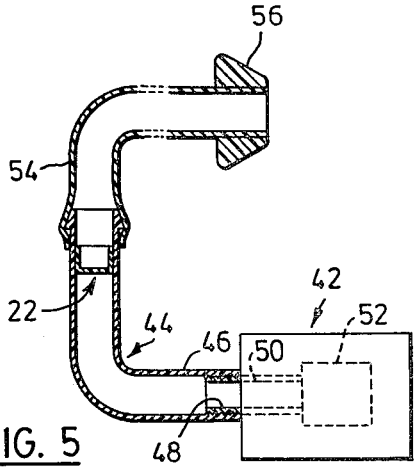
FIG. 5 is a diagrammatic view showing the damping element of the invention in a hearing aid.

A typical hearing aid 42 embodying the invention is diagrammatically shown in FIG. 5. As there shown, the earpiece 44 of the aid is formed by a piece of molded plastic tubing 46, in which the damping element 22 has been inserted. The tubing 46 is screwed to the rim 48 of a tube 50 which leads to the transducer 52 of the aid. A flexible plastic tube 54 extends from tube 46 to the ear mold 56 which fits within the ear of the user.

Normally the diameters of the screen and fabric discs 14, 18 will be the same, but this is not essential, so long as they are sufficient to hold the damping element in place. The diameter of the fabric disc should not however be substantially greater than that of the screen disc, since it would be undesirable to have fabric ends flopping in the passage 12.

Although the invention has been described for use in tubing, it may be used in any cylindrical passage in equipment which is not subjected to unduly heavy shocks and air movement. In addition, although the discs 14, 18 have been shown as circular, they may be of other shapes, so long as their ends when formed into cylindrical sidewalls do not objectionably interfere with the travel of sound through the passage 12.

I claim:

1. In a sound conducting member having an interior passage defined by a cylindrical interior wall, an acoustical damping element comprising: a flexible fabric member of selected acoustic resistance, a wire screen overlying said fabric member and being separate from and unattached to said fabric member, said wire screen and fabric member each having a central circular portion positioned across said interior passage, and each having a periphery bent into a cylindrical sidewall, the cylindrical sidewall of said screen overlying the cylindrical sidewall of said fabric member and pressing the cylindrical sidewall of said fabric member against each interior wall, said fabric member being held in said passage substantially solely by the pressure of said cylindrical sidewall of said screen against said cylindrical sidewall of said fabric member.

2. The invention according to claim 1 wherein the length of said cylindrical sidewall of said screen is between one-third and one times the diameter of said passage.

3. The invention according to claim 2 wherein said cylindrical sidewalls of said fabric member and said screen are of substantially the same length.

4. The invention according to claim 1 wherein said sound conducting member is a tubular member, said tubular member constituting at least a portion of the earpiece of a hearing aid.

5. A method of forming an acoustical damping element in a cylindrical passage comprising:

(a) positioning a fabric member and a metal screen, each of dimension greater than that of said passage, across the mouth of said passage, with said screen overlying said fabric member, said screen being separate from and unattached to said fabric member, and (b) forcing a cylindrical insertion tool, of diameter slightly less than that of said passage, against said screen to force said screen and fabric into said passage, thereby forming said fabric and screen into closed end concentric cylinders in said passage with said screen pressing said fabric against the wall of said passage and with said fabric member being held in said passage substantially solely by the pressure of said cylindrical sidewall of said screen against said cylindrical sidewall of said fabric member.

6. The method according to claim 5 and including the step of positioning a sheet of said fabric over said passage, positioning a sheet of said screen over said fabric, moving a punch through said sheets to produce a pair of discs of said fabric and said screen, said disc of fabric being said fabric member, and then carrying out said step (b).

* * * * *